US008100596B2

(12) United States Patent
Hsu et al.

(10) Patent No.: US 8,100,596 B2
(45) Date of Patent: Jan. 24, 2012

(54) THERMAL SUBLIMATION IMAGING APPARATUS AND THERMAL SUBLIMATION PRINTER USING THE SAME

(75) Inventors: Wei-Ting Hsu, Jhubei (TW); Li-Chung Liu, Jhubei (TW); Wan-Chih Lin, Hsinchu (TW)

(73) Assignees: Silitek Eelctronic (GZ) Co., Ltd., Guangzhou (CN); Lite-On Technology Corporation, Taipei (TW)

( * ) Notice: Subject to any disclaimer, the term of this patent is extended or adjusted under 35 U.S.C. 154(b) by 804 days.

(21) Appl. No.: 12/232,121

(22) Filed: Sep. 11, 2008

(65) Prior Publication Data

US 2009/0123208 A1 May 14, 2009

(30) Foreign Application Priority Data

Nov. 13, 2007 (CN) ..... 2007 1 0031419

(51) Int. Cl.
*B41J 11/00* (2006.01)

(52) U.S. Cl. ..... 400/648

(58) Field of Classification Search ..... 400/648–660; 347/220

See application file for complete search history.

(56) References Cited

U.S. PATENT DOCUMENTS 5,433,544 A * 7/1995 Aizawa et al. ..... 400/649
6,102,590 A * 8/2000 Harris et al. ..... 400/56
6,412,995 B2 * 7/2002 Togashi et al. ..... 400/649
7,210,866 B2 * 5/2007 Silverbrook ..... 400/56
7,344,324 B2 * 3/2008 Sawai ..... 400/120.16
7,551,191 B2 * 6/2009 Nishitani ..... 347/220
7,780,367 B2 * 8/2010 Yoshioka ..... 400/120.16
7,929,005 B2 * 4/2011 Hirai et al. ..... 347/198
2004/0258443 A1 * 12/2004 Takeshita et al. ..... 400/58
2005/0232679 A1 * 10/2005 Na et al. ..... 400/649
2006/0159504 A1 * 7/2006 Blanchard et al. ..... 400/120.16
2006/0274143 A1 * 12/2006 Takasaka et al. ..... 347/220

* cited by examiner

*Primary Examiner* — Michael G Lee
*Assistant Examiner* — David Tardif
(74) *Attorney, Agent, or Firm* — Rosenberg, Klein & Lee

(57) ABSTRACT

A thermal sublimation imaging apparatus and a thermal sublimation printer using the same are described. A print head of the thermal sublimation imaging apparatus is fixed, a platen capable of contacting or separating from the fixed print head is lifted up to contact the fixed print head, and an elastic component is used in conjunction to provide a pressure for printing. The platen lays flat in paper feed/reverse mode, and presses downwardly to drive a paper pickup plate to fetch paper. These actions are achieved by a stepper motor together with a sensor through a worm shaft, a worm gear, and at least a gear. Therefore, the number and the cost of the gears are reduced, and the time for switching the printing action is greatly reduced since the switching can be implemented within a very small rotation angle.

20 Claims, 9 Drawing Sheets

THERMAL SUBLIMATION IMAGING APPARATUS AND THERMAL SUBLIMATION PRINTER USING THE SAME

CROSS-REFERENCE TO RELATED APPLICATIONS

This non-provisional application claims priority under 35 U.S.C. §119(a) on Patent Application No(s). 200710031419.3 filed in China, P.R.C. on Nov. 13, 2007 the entire contents of which are hereby incorporated by reference.

BACKGROUND OF THE INVENTION

1. Field of Invention

The present invention relates to an imaging apparatus, in particularly to a thermal-sublimation imaging apparatus and a thermal sublimation printer using the same.

2. Related Art

Thermal-sublimation imaging technique is widely used in photo printing, and works according to the following principle. Dry solid ink on a ribbon, i.e., a mixture of a toning agent and a polymer thinly coated on the ribbon may be divided into yellow, cyan, and magenta, and the size of the ribbon is slightly larger than that of the photo paper to be printed. When printing, the photo paper and ribbon pass through a platen simultaneously, and are heated together under a print head. The heat-generating dots array of monocrystalline silicon with a diameter less than 40 μm on the print head is supplied with power, so as to melt the dry solid ink coated on the ribbon. During heating, polymer molecules are separated at about 320 Fahrenheit degrees. When the print head has passed, the temperature drops, and the ink is changed from gas state into solid state, thus the ink is embedded in the polymer, and then the polymer molecules are polymerized together. After one color is printed, the printing is repeated automatically to print next color. Accordingly, the ribbon is sublimated to generate a mixture of millions of colors on a photo paper, thereby achieving an optimal photo effect.

The printing process has three steps including paper pickup, paper feeding/reversing with ribbon spooling, and printing. In printing, only one color is printed on the paper at a time, and after transferring three colors onto the paper, a protection layer must be added. Therefore, the paper feeding/reversing with ribbon spooling step and the printing step must be repeated four times. In the printing step, a pressure is required between the platen and the print head to uniformly transfer the dyes onto the paper.

In the conventional thermal sublimation printers, in order to realize the actions such as providing pressure for printing, paper pickup, and paper feeding/reversing, a cam or other mechanisms are generally required to switch among these actions, thus increasing the manufacturing cost and the time for printing.

SUMMARY OF THE INVENTION

The present invention is directed to a low-cost thermal sublimation imaging apparatus capable of saving the time for printing and a thermal sublimation printer using the same.

The present invention provides a thermal sublimation imaging apparatus, which includes a fixed print head; a platen, capable of contacting or separating from the print head and having a roll shaft; and a rotating shaft of the platen, mounted in parallel with the roll shaft, capable of rotating within a certain range of angle, and fitted with a first shaft bush, an elastic component, and a second shaft bush sequentially from two ends towards a center thereof. The second shaft bush is solidly connected on the rotating shaft. Two ends of the elastic component are respectively connected to the first shaft bush and the second shaft bush. The first shaft bush has a first connection hole and a second connection hole. One end of the rotating shaft is fitted in the first connection hole, and one end of the roll shaft of the platen is fitted in the second connection hole. When the platen separates from the print head, the first shaft bush sways up and down with the rotation of the rotating shaft to drive the platen to move up and down. When the platen contacts the print head, the rotating shaft rotates relative to the first shaft bush, so as to deform the elastic component to generate a torsion.

Preferably, the second shaft bush and the rotating shaft are solidly connected through a D-shaped slot combination. The elastic component includes a torsion spring.

In order to initialize the phase of the rotating shaft of the platen, a sensor is disposed on a frame where the thermal sublimation imaging apparatus is disposed at an end adjacent to the rotating shaft of the platen. A positioning block is disposed and solidly connected to the rotating shaft to work in cooperation with the sensor. The sensor has a first end for emitting signals and a second end for receiving signals. The positioning block rotates with the rotating shaft to a position between the first end and the second of the sensor, so as to block the transmission of the signals of the sensor.

Furthermore, the thermal sublimation imaging apparatus further includes a stepper motor drive system for driving and precisely controlling the rotating shaft of the platen to rotate within a certain range of angle.

Furthermore, the thermal sublimation imaging apparatus further includes a transmission system having a worm shaft and a worm gear for driving the rotating shaft of the platen to rotate. The worm gear is engaged with a gear for driving the rotating shaft of the platen to rotate. The transmission system further includes a first gear coaxial with the worm gear and a second gear engaged with the first gear. The power of the stepper motor drive system is transmitted to the rotating shaft of the platen through the second gear.

The present invention further provides a thermal sublimation printer using the thermal sublimation imaging apparatus. The printer includes a paper pickup unit, a printing unit, and a paper cassette for accommodating paper. The paper pickup unit includes at least one paper pickup roller and a paper lift plate. The paper lift plate has a first end adjacent to the at least one paper pickup roller and a second end adjacent to the printing unit. The second end has a fulcrum, and the paper lift plate rotates around the fulcrum within a certain range of angle. The printing unit is the thermal sublimation imaging apparatus. When the platen contacts the print head, the rotating shaft rotates relative to the first shaft bush, so as to deform the elastic component to generate a torsion. When the platen separates from the print head, the first shaft bush sways up and down with the rotation of the rotating shaft, so as to drive the platen to move up and down to a laid flat position (i.e., a first position) or a press-down position (i.e., a second position). When the platen moves to the press-down position, a portion of the second end of the paper lift plate adjacent to the platen is pressed, such that the paper lift plate rotates around the fulcrum to make the paper lift plate to tilt upwardly, thus the paper in the paper cassette is lifted up to contact the paper pickup roller, thereby starting to pickup paper.

In detail, the paper cassette includes a base, a paper tray, and a cover. The base includes a bottom having a hollowed out portion. The first end of the paper lift plate is fitted deeply in the hollowed out portion. The paper tray is disposed on the bottom and includes a movable end and an opposite fixed end. The movable end is covered on the hollowed out portion. When the first end of the paper lift plate tilts upwardly, the movable end of the paper tray is lifted up.

Preferably, the first end and the second end of the paper lift plate are connected through a shaft. The shaft is fitted with a torsion spring, and two ends of the torsion spring are solidly connected to the first end and the second end of the paper lift plate respectively.

Furthermore, the printer further includes a transferring unit. When the platen moves to a laid flat position, the transferring unit performs a paper feeding/reversing action.

Compared with the prior art, in the thermal sublimation printer of the present invention, the platen is only required to move up and down in a small extent when switching between the paper feeding/reversing step and the printing step. It needs to be done 8 times switching to finish printing one image product, and thus the time for printing of the printer can be effectively reduced. Further, in the course of paper pickup, paper feeding/reversing, and printing, a self-locking function of the worm shaft and worm gear helps to suspend the supply of power to the stepper motor that drives the rotating shaft of the platen, thereby reducing power consumption and the cost.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
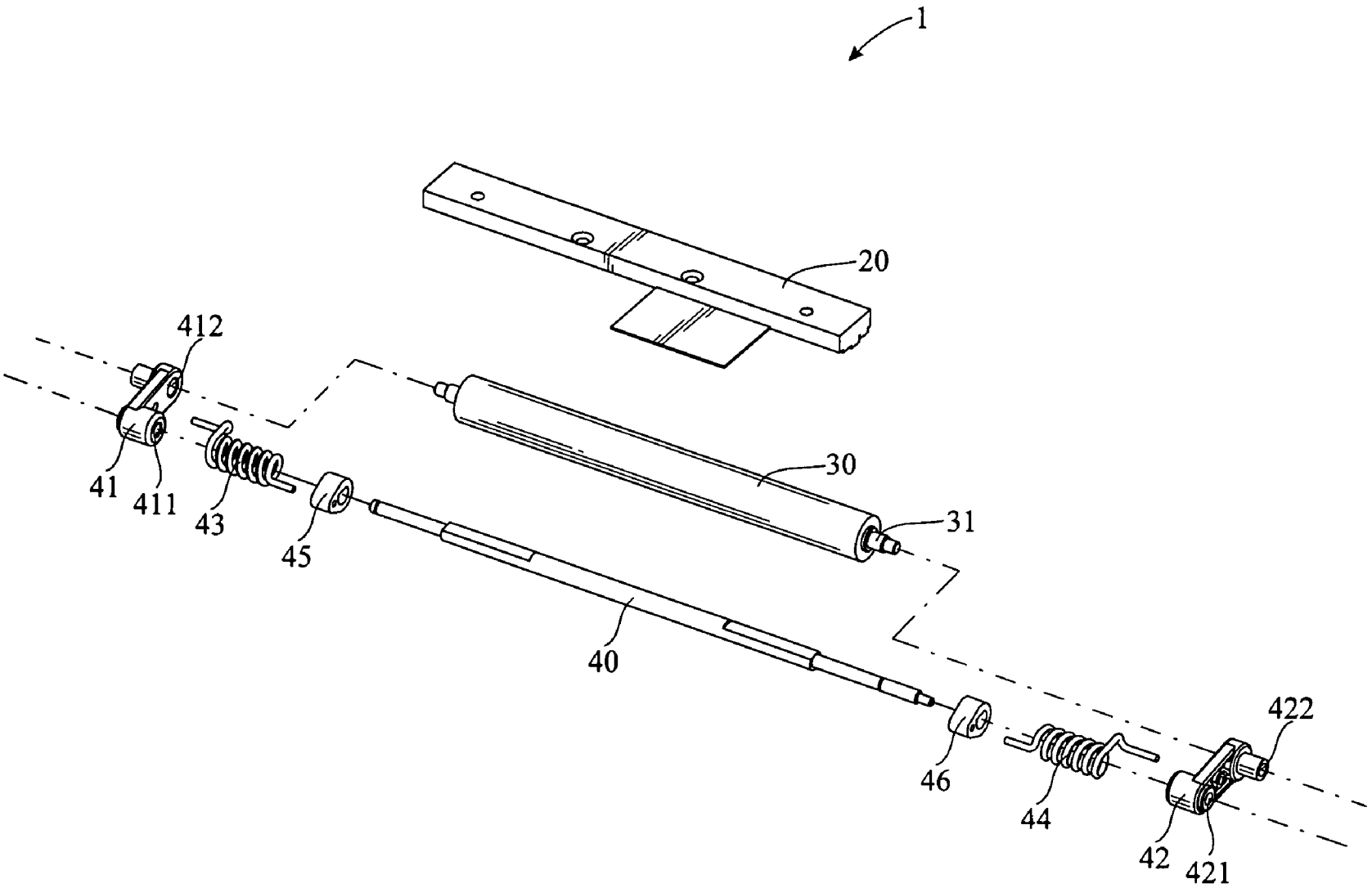
FIG. 1 is an exploded view of a thermal sublimation imaging apparatus according to an embodiment of the present invention, in which a drive system and a transmission system for actuating a rotating shaft of the platen of the thermal sublimation imaging apparatus are not shown.
Figure 2:
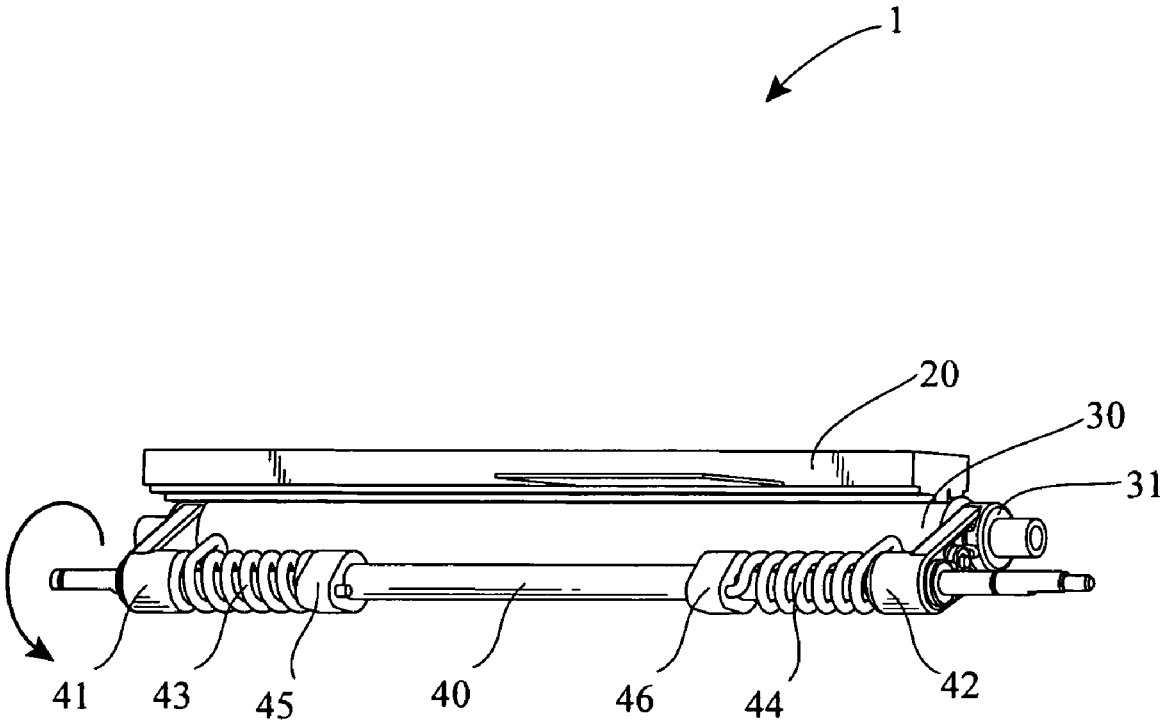
FIG. 2 is a perspective view of a thermal sublimation imaging apparatus according to an embodiment of the present invention, in which a drive system and a transmission system for driving a rotating shaft of the platen of the thermal sublimation imaging apparatus are not shown.

Referring to FIG. 1, a thermal sublimation imaging apparatus 1 includes a fixed print head 20, a platen 30 contacting or separating from the print head 20, and a rotating shaft 40 of the platen rotating within a certain range of angle. The rotating shaft 40 is sequentially sleeved with first shaft bushes 41, 42, torsion springs 43, 44, and second shaft bushes 45, 46 from two ends towards a center thereof. The second shaft bushes 45, 46 are connected with the rotating shaft 40 through a D-shaped slot combination, and thus the rotating shaft 40 cannot rotate relative to the second shaft bushes 45, 46. The torsion springs 43, 44 are sleeved with the rotating shaft 40. The torsion spring 43 is connected at one end to the second shaft bush 45, and at the other end to the first shaft bush 41. Likewise, the torsion spring 44 is connected at one end to the second shaft bush 46, and at the other end to the first shaft bush 42. The first shaft bush 41 includes a first connection hole 411 and a second connection hole 412. One end of the rotating shaft 40 is sleeved in the first connection hole 411, and one end of a roll shaft 31 of the platen 30 is sleeved in the second connection hole 412. Likewise, the first shaft bush 42 includes a first connection hole 421 and a second connection hole 422. The other end of the rotating shaft 40 is sleeved in the first connection hole 421, and the other end of the roll shaft 31 of the platen 30 is sleeved in the second connection hole 422. When the rotating shaft 40 rotates, the first shaft bushes 41, 42 sway up and down with the rotation of the rotating shaft 40 to drive the platen 30 to move up and down, thereby making the platen 30 to contact or separate from the print head 20. Since the first shaft bushes 41, 42 is in a common circular shaft connection with the rotating shaft 40, the rotating shaft 40 may rotate relative to the first shaft bushes 41, 42 under a certain force. That is, as shown in FIG. 2, the rotating shaft 40 of the platen rotates in anticlockwise direction. The first shaft bushes 41, 42 sway upwardly to drive the platen 30 to move upwardly, so as to contact the print head 20. After the platen 30 contacts the print head 20, the rotating shaft 40 of the platen continues rotating in the anticlockwise direction. As being blocked by the print head 20, the platen 30 cannot further move upwardly, and the first shaft bushes 41, 42 suspend rotating. At this time, the continuous rotation of the rotating shaft 40 drives the second shaft bushes 45, 46 to rotate continuously, thus deforming the torsion springs 43, 44 to generate a torsion in the anticlockwise direction, such that the first shaft bushes 41, 42 is prone to sway upwardly, thereby providing an upward printing pressure for the platen 30.

The rotating shaft 40 of the platen is actuated by a drive system and a transmission system (not shown in FIGS. 1 and 2). The details of the drive system and the transmission system may be described in an embodiment of a thermal sublimation printer 100 using the thermal sublimation imaging apparatus 1 with reference to FIG. 3.

Figure 3:
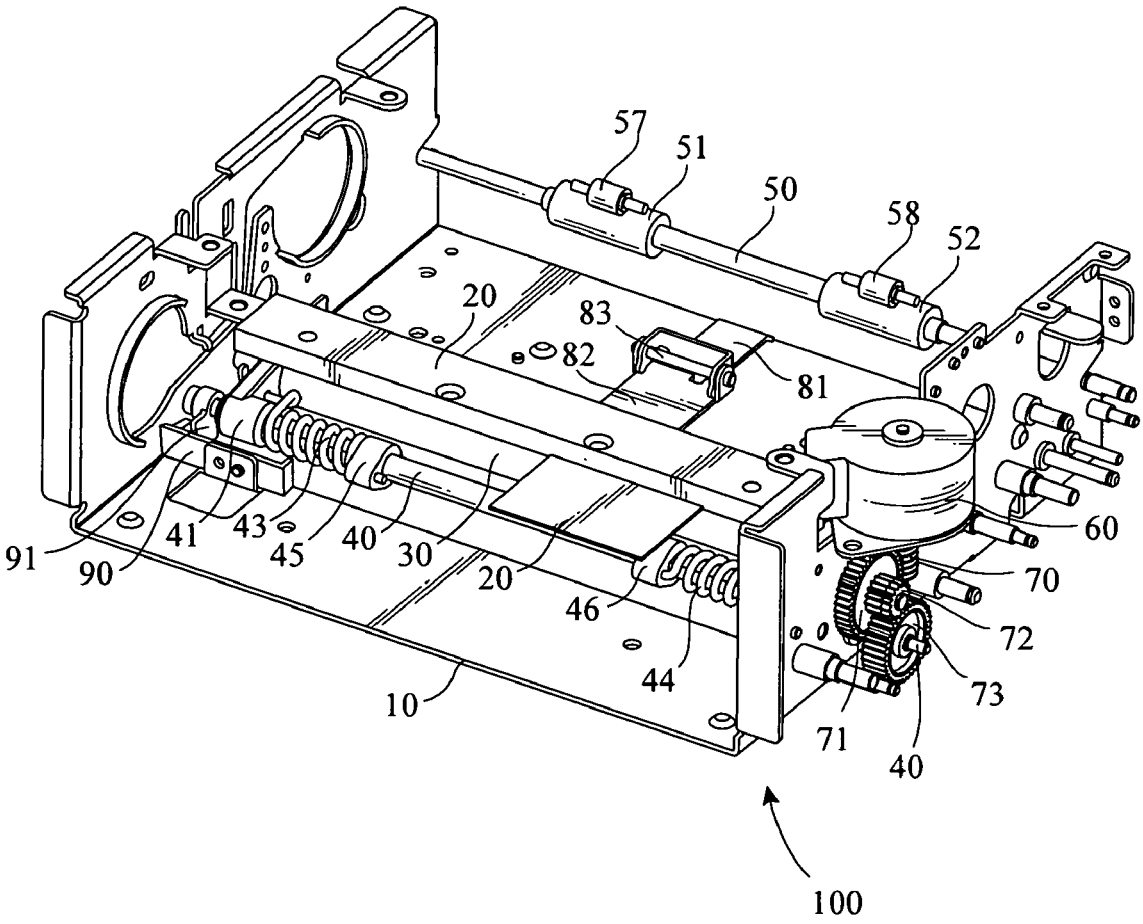
FIG. 3 is a perspective view of a thermal sublimation printer according to an embodiment of the present invention.

Referring to FIG. 3, a thermal sublimation printer 100 using the thermal sublimation imaging apparatus 1 includes a frame 10. The print head 20 is solidly mounted on the frame 10. The rotating shaft 40 of the platen is mounted on the frame 10 and is rotatable within a certain range of angle. The power for driving the rotating shaft 40 of the platen to rotate originates from a stepper motor 60 and is transmitted to the rotating shaft 40 through a worm shaft 70, a worm gear 71 engaged with the worm shaft 70, a first gear 72 coaxial with the worm gear 71, and a second gear 73 engaged with the first gear 72 successively. The rotating shaft 40 and the second gear 73 are associated through a D-shaped slot. The stepper motor 60 precisely controls the parameters, such as rotation directions and the numbers of rotation step of the worm shaft 70. Therefore, the rotating shaft 40 rotates precisely in anticlockwise or clockwise direction within a certain range of angle. The first shaft bushes 41, 42 connect the rotating shaft 40 and the platen 30, such that the platen 30 moves up and down with the rotation of the rotating shaft 40, thereby making the platen 30 to contact or separate from the print head 20.

Figure 4:
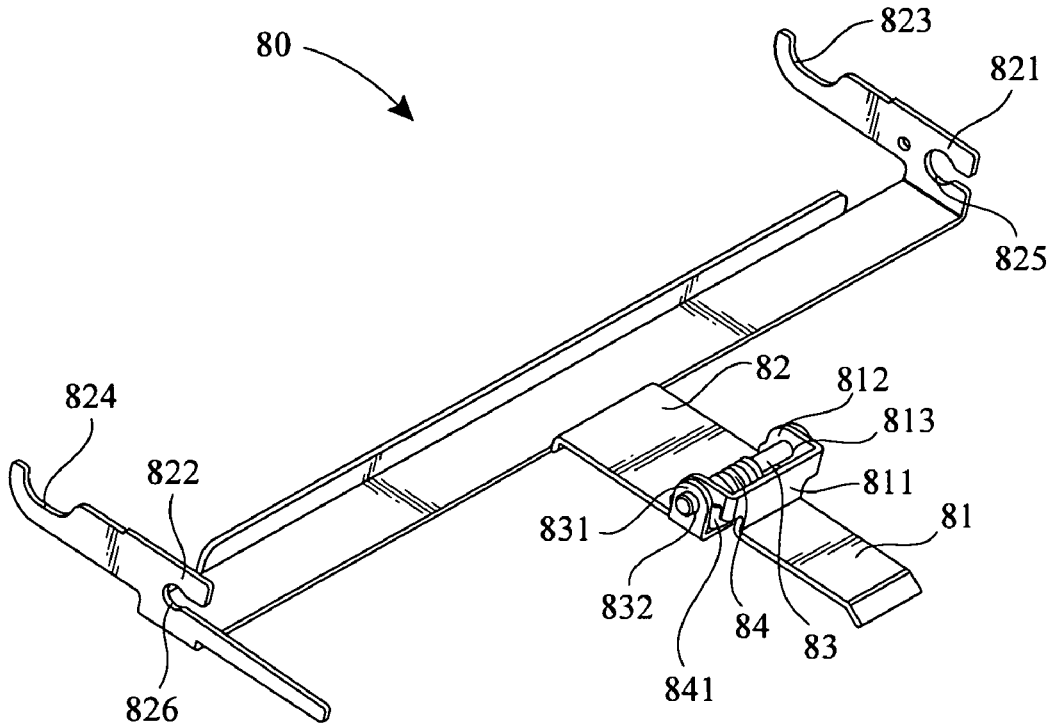
FIG. 4 is a three-dimensional perspective view of a paper lift plate in FIG. 3.
Figure 5:
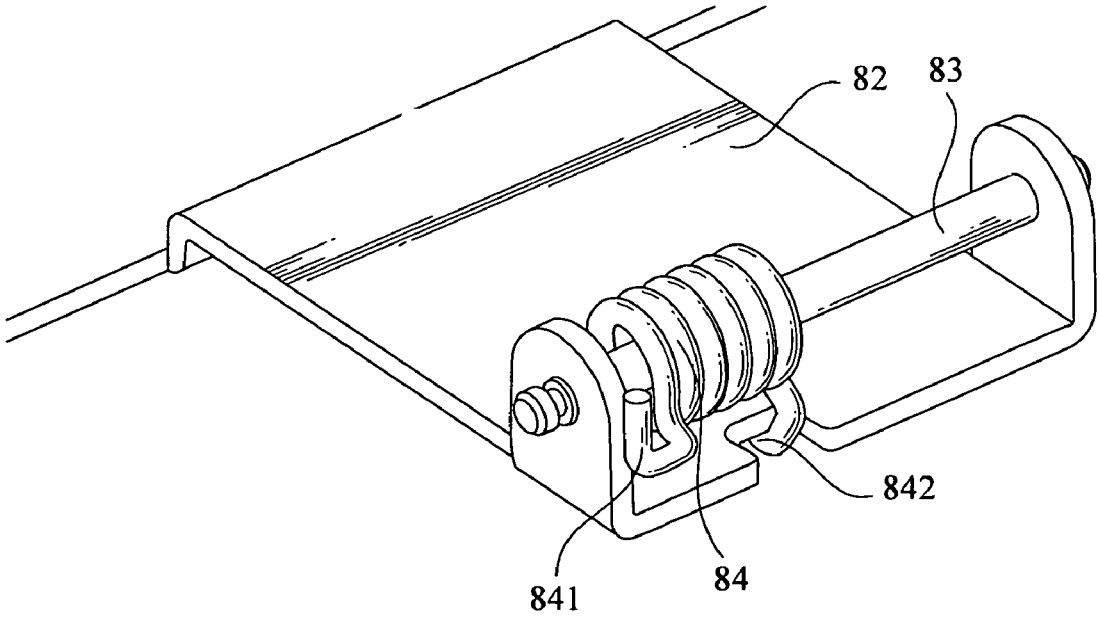
FIG. 5 is a three-dimensional perspective view of the paper lift plate with a first end removed.
Figure 6:
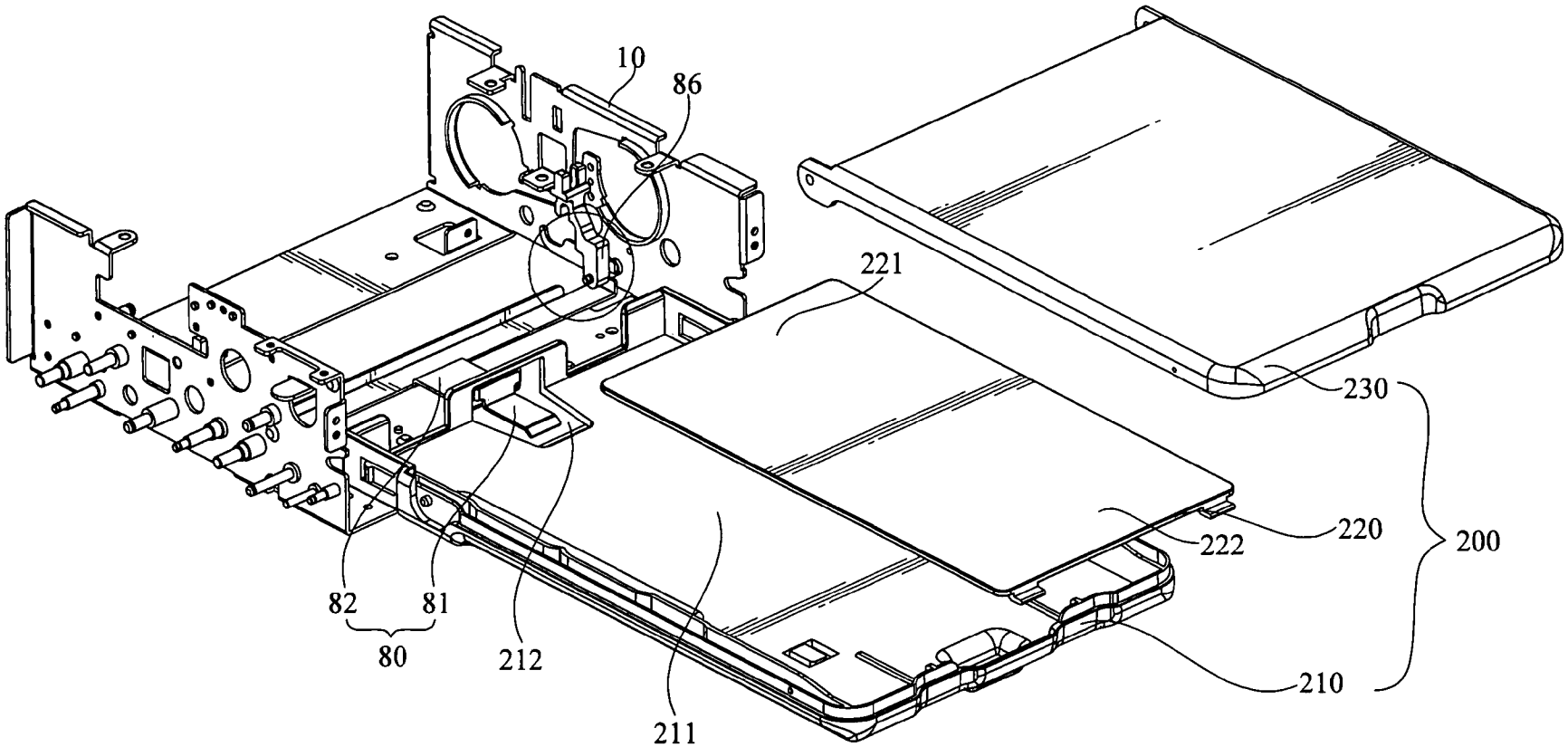
FIG. 6 is a three-dimensional schematic view of the paper lift plate in conjunction with a paper cassette.
Figure 7:
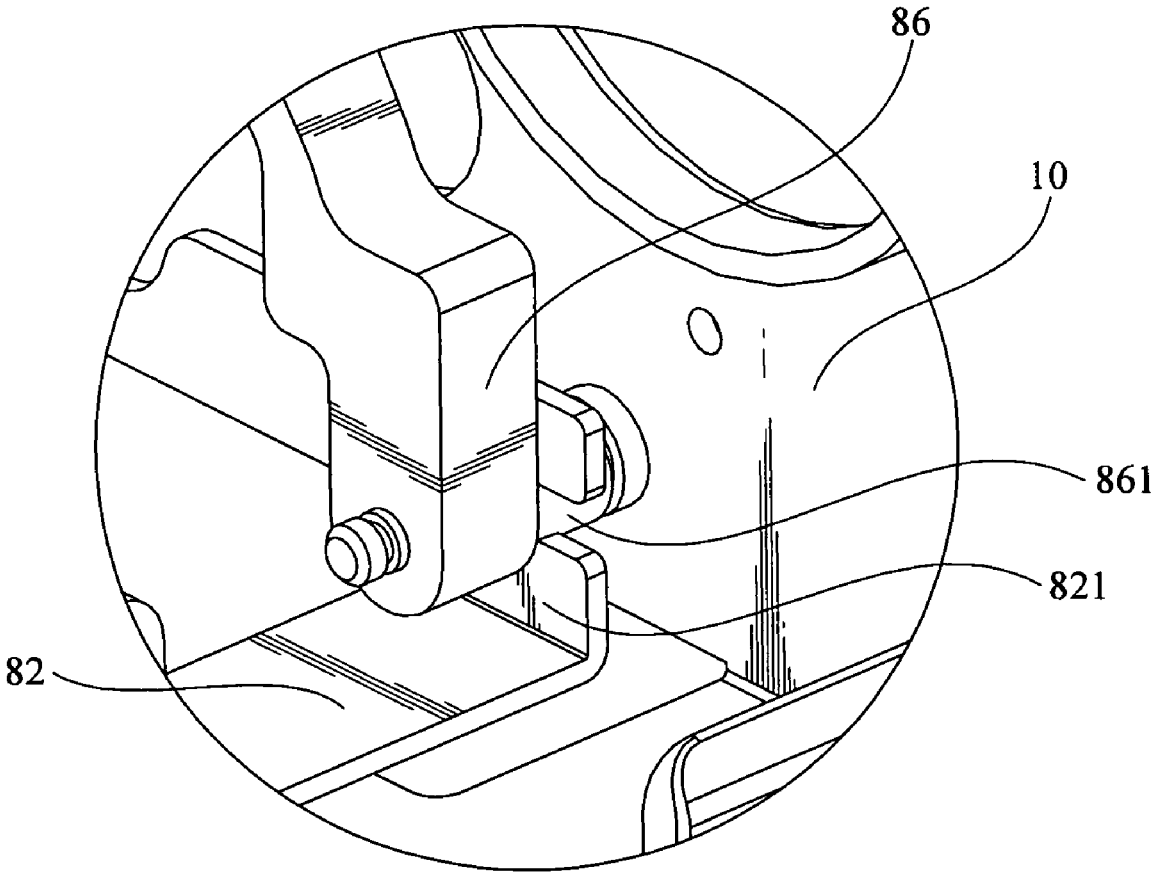
FIG. 7 is a partial enlarged view of a connection portion of the paper lift plate in FIG. 6 and a frame.

Referring to FIGS. 4 to 7, a paper lift plate 80 is mounted at the bottom of the frame 10. First, referring to FIG. 4, the paper lift plate 80 includes a first end 81 and a second end 82. The first end 81 and the second end 82 are connected in a hinge manner by a shaft 83. In detail, one end of the first end 81 connected to the shaft 83 extends to form a bending portion 811 extending upwardly. The bending portion 811 has two sidewalls 812 in which a shaft bore 813 is formed respectively. The first end 81 is sleeved on the shaft 83 through the shaft bore 813. Likewise, a connection portion of the second end 82 and the shaft 83 also extends along a first portion adjacent to the first end 81 from the second end 82 to form at least one bending portion 831 extending upwardly. The bending portion 831 is also formed with a shaft bore 832. The second end 82 is sleeved on the shaft 83 through the shaft bore 832. The first end 81 is sleeved on the inner side of the second end 82. Particularly, the shaft 83 further has a torsion spring 84 sleeved thereon. The torsion spring 84 has tow ends, in which one end 841 is engaged at the outer side of the sidewall 812 of the bending portion 811 of the first end 81 of the paper lift plate 80, and the other end 842 is engaged at the lower side of the bottom of the second end 82 of the paper lift plate 80, as shown in FIG. 5. Further, the second end 82 extends in a direction departing from the first end 81 to a second portion adjacent to the platen 30. The width of the second portion of the second end 82 is enlarged to be greater than the length of the platen 30. Two ends along the width direction of the second portion of the second end 82 extend vertically to form sidewalls 821, 822 respectively. The sidewalls 821, 822 may contact the roll shaft 31 of the platen 30, and have respective pivot points 825, 826 through which the paper lift plate 80 and the frame 10 are connected. The pivot points 825, 826 are located on a same horizontal level and form an imaginary axis according to the principle that two points define a line. The paper lift plate 80 rotates around the imaginary axis formed by the pivot points 825, 826. That is, when the platen 30 moves downwardly, the roll shaft 31 of the platen 30 presses the sidewalls 821, 822 downwardly, so as to press down the portion at the side of the pivot points 825, 826 on the paper lift plate 80 adjacent to platen. Thus, the other side of the pivot points 825, 826 on the paper lift plate 80 away from the platen, i.e., the portion adjacent to the paper cassette tilts upwardly according to the lever principle, thereby lifting up the paper in the paper cassette. Preferably, one end of the sidewalls 821, 822 adjacent to the platen 30 has a pair of fitting slots 823, 824. When the platen 30 moves downwardly, the roll shaft 31 just falls into the fitting slots 823, 824 and presses the paper lift plate 80 to rotate around the imaginary axis formed by the pivot points 825, 826. In detail, the pivot points 825, 826 may be an engagement slot structure as shown in FIG. 4. In more detail, as shown in FIG. 7, the paper lift plate 80 and the frame 10 are connected by a bushing 86 and a rivet 861 solidly connected with the frame 10. The paper lift plate 80 is engaged with the rivet 861 extending from the frame to the bushing 86 through the engagement slot structure. The paper lift plate 80 can rotate around the rivet 861. Definitely, the rivet 861 can also be replaced by a shaft extending on the frame 10. One of the pivot points 825, 826 can have a round-hole structure, as long as the paper lift plate 80 can be connected to the frame 10 and rotate with the frame 10 as a fulcrum.

Next, as shown in FIG. 6, the thermal sublimation printer includes a paper cassette 200. The paper cassette 200 includes a base plate 210, a paper tray 220, and a cover 230. The base plate 210 includes a bottom 211 with a hollowed portion 212. The paper tray 220 is disposed on the bottom 211 and includes a movable end 221 and a fixed end 222 positioned relative to the movable end 221. The movable end 221 is positioned on the hollowed portion 212. The first end 81 of the paper lift plate 80 is fitted deeply in the hollowed portion 212. When the first end 81 of the paper lift plate 80 tilts upwardly, the movable end 221 of the paper tray 220 is lifted up. The force provided by the rotating shaft of the platen for forcing the second end 82 of the paper lift plate to move downwardly is the same at each time the paper is picked up, and the arm of force is also the same. Therefore, when different pieces of papers is placed on the paper tray 220, due to the different total weight of the papers, the first end 81 of the paper lift plate 80 tilting upwardly encounters different resistances. In order to provide a certain paper pickup pressure (i.e., the force for making the first end 81 to tilt upwardly to press the paper on paper pickup roller 51), the present invention adopts the paper lift plate 80 divided into the first end 81 and the second end 82, and the torsion spring 84 disposed between the first end 81 and the second end 82, so as to ensure the consistent paper pickup pressure for the first paper through the last paper in the paper cassette.

Referring to FIG. 3, the frame 10 further has a paper pickup roll shaft 50 disposed above the first end 81 of the paper lift plate 80. The paper pickup roll shaft 50 has paper pickup rollers 51, 52. The paper pickup rollers 51, 52 have a pair of paper exit rollers 57, 58 thereabove correspondingly.

Figure 8:
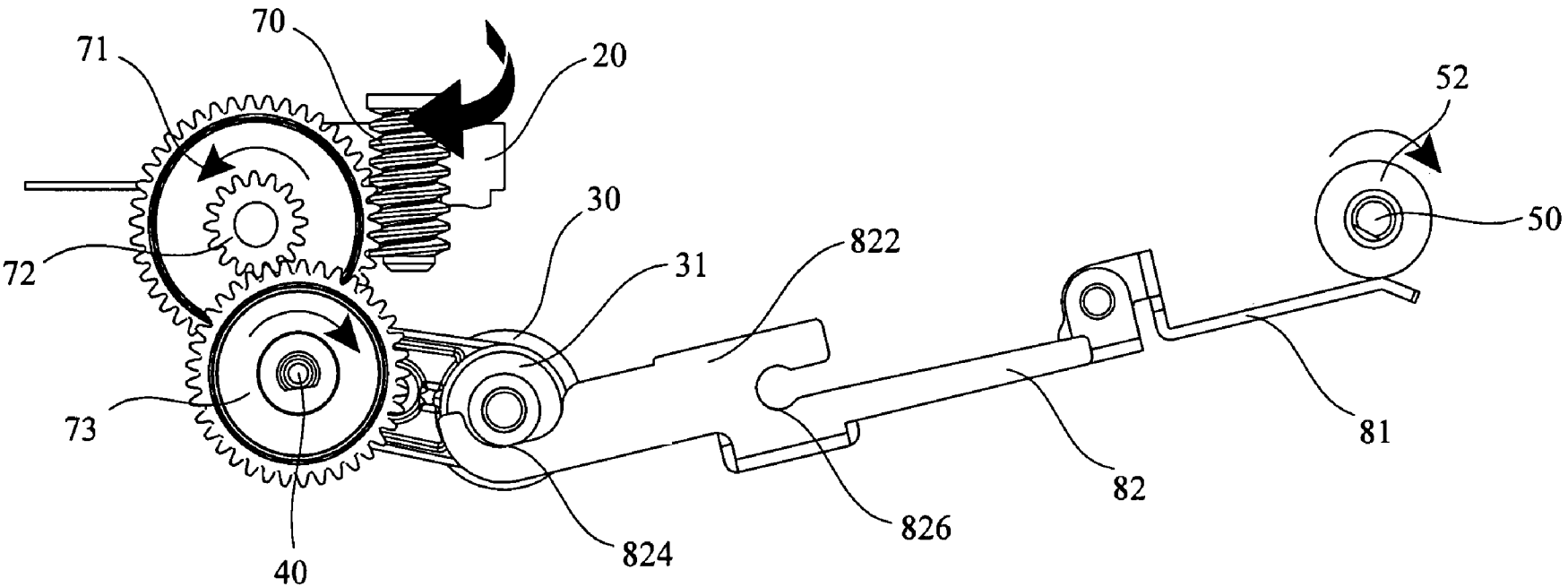
FIG. 8 is a schematic side view of the thermal sublimation printer according to the embodiment of the present invention when picking up a paper.

Further, the thermal sublimation printer further includes a transferring unit. The transferring unit includes a pair of transfer rollers and a transmission system. The pair of transfer rollers includes a paper pickup roller and a paper press roller for delivering paper, feeding/reversing paper, and precisely locating paper when switching between the printing and ribbon spooling processes. In detail, the paper pickup rollers of the pair of transfer rollers have needle-like spurs, and after being pressed tightly with the paper press rollers, a portion of the spurs pierce into a rubber layer on the back of the paper, so as to ensure the paper is at the same position when being printed back and forth. As shown in FIGS. 8 and 3, when picking up the paper, the worm shaft 70 rotates in clockwise direction indicated by the arrow, and the rotating shaft 40 also rotates in clockwise direction. The first shaft bushes 41, 42 sway downwardly, and thus the platen 30 moves downwardly. The roll shaft 31 is embedded in the fitting slots 823, 824 and presses the portion at the side of pivot points 825, 826 on the paper lift plate 80 adjacent to the platen 30 to move downwardly, and thus the paper lift plate 80 rotates with the pivot points 825, 826 as fulcrums, that is, the portion at the other end of the pivot points 825, 826 away from the platen and the first end 81 tilt upwardly according to the lever principle. Thus, the paper in the paper cassette is lifted up to contact the paper pickup rollers 51, 52. In the course of paper pickup, the supply of power to the stepper motor 60 can be suspended. Since the worm shaft and the worm gear have the self-locking function, when the stepper motor 60 suspend working, the parts, such as the worm shaft 70, the worm gear 71, the first gear 72, the second gear 73, and the rotating shaft 40 of the platen are in a quiescent state and will not keep on rotating or rotate in reverse direction under other forces.

Figure 9:
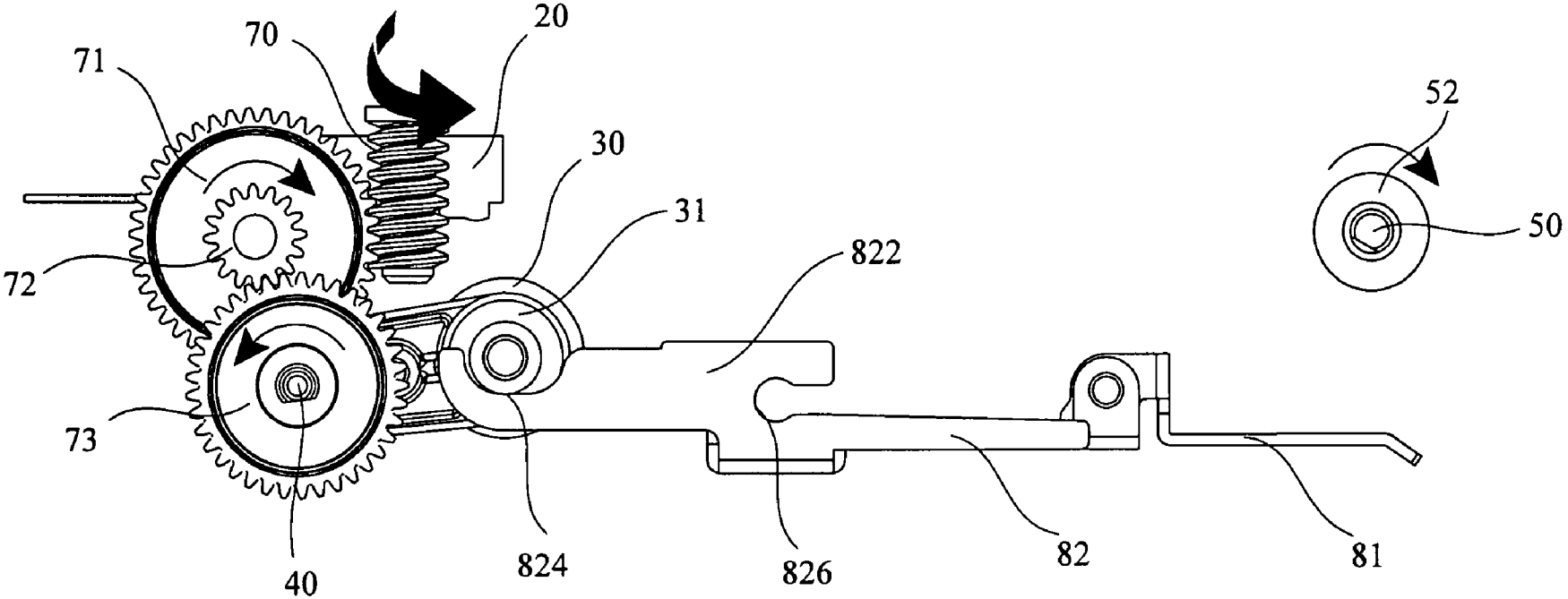
FIG. 9 is a schematic side view of the thermal sublimation printer according to the embodiment of the present invention when feeding/reversing a paper.

After the paper is picked up, the worm shaft 70 rotates in the anticlockwise direction, and the rotating shaft 40 also rotates in the anticlockwise direction. The first shaft bushes 41, 42 sway upwardly to lift up the platen 30 to the laid flat position, at this time, the paper lift plate 80 is returned to the laid flat position, as shown in FIG. 9, and the paper is transferred by a transferring unit to a printing region. When transferring paper, the supply of power to the stepper motor 60 can also be suspended.

Figure 10:
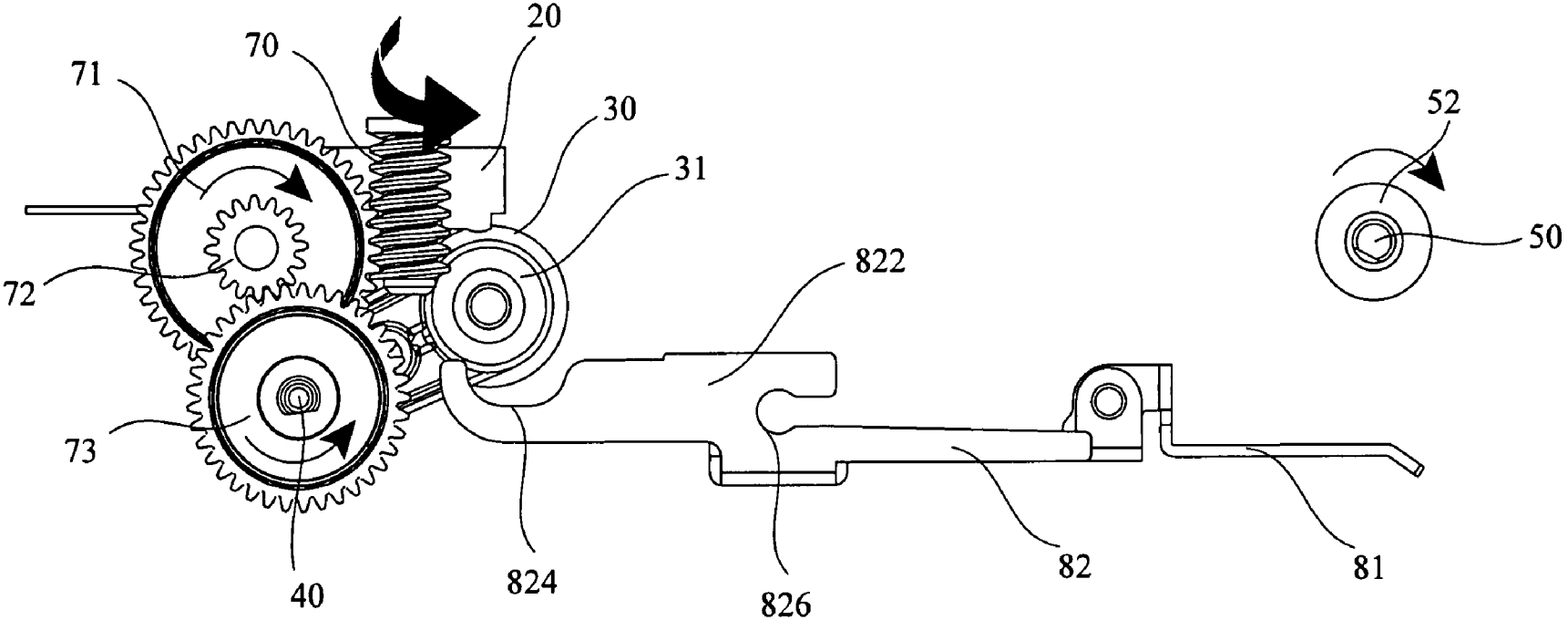
FIG. 10 is a schematic side view of the thermal sublimation printer according to the embodiment of the present invention when printing.

When the paper is transmitted to a printing waiting position, the worm shaft 70 continues to rotating in anticlockwise direction, the rotating shaft 40 also rotates in anticlockwise direction, and the first shaft bushes 41, 42 sway upwardly continuously, so as to make the platen 30 to contact the print head 20, as shown in FIG. 10. At this time, the rotating shaft 40 of the platen continues rotating in the anticlockwise direction. Since being blocked by the print head 20, the platen 30 cannot move upwardly, thus the first shaft bushes 41, 42 suspend rotating. The continuous rotation of the rotating shaft 40 drives the second shaft bushes 45, 46 to rotate continuously, thus deforming the torsion springs 43, 44 connected to the first shaft bush and the second shaft bush to generate an anticlockwise torsion. Thus, the first shaft bushes 41, 42 are prone to sway upwardly, thereby providing an upward printing pressure for the platen 30. When the printing pressure is adequate, the supply of power to the stepper motor 60 is suspended. Due to the self-locking function of the worm shaft 70, the parts, such as the worm shaft 70, the worm gear 71, the first gear 72, the second gear 73, and the rotating shaft 40 of the platen will not move, and the torsion springs 43, 44 maintains a stable torsion, thereby providing a stable printing pressure.

When printing, a color of an image to be printed on the entire paper is first printed on the paper. That is, the entire paper starts from the printing waiting position and then passes through the primary printing region. Next, the stepper motor 60 is actuated and the worm shaft 70 is controlled to change the rotation direction, i.e., to rotate in clockwise direction, such that the rotating shaft 40 is also made to rotate in the clockwise direction. Then, the torsion of the torsion springs 43, 44 is released, and the first shaft bushes 41, 42 are made to sway downwardly, such that the platen 30 separates from the print head 20, and moves downwardly to return to the laid flat position as shown in FIG. 9. Then, the paper is reversed, that is, the paper printed with a color is sent back to the printing waiting position. When the paper is reversed, the stepper motor 60 is not supplied with power. After the paper is sent back to the printing waiting position, the stepper motor 60 is actuated again, and the platen 30 is returned to the printing position, so as to start printing another color. This process is repeated three or four times. After the whole image is printed, the paper is completely ejected out of the machine, and the platen 30 is lowered to the lowest position as shown in FIG. 8 so as to pick up the next paper to be printed.

It should be particularly noted that in the course of switching between the paper feeding/reversing and the printing state, according the embodiment, the rotating shaft 40 of the platen is only required to rotate by 35 degrees. In printing, the switching action needs to be done 8 times, thus the apparatus of the present invention can effectively reduce the time for printing. Furthermore, in the course of feeding/reversing and printing paper, the self-locking function of the worm shaft and the worm gear can be fully used to suspend supplying power to the stepper motor 60, so as to save energy.

It should be illustrated that referring to FIG. 3, in order to initialize the phase of the rotating shaft 40 of the platen, a sensor 90 is disposed on the frame 10 at one end adjacent to the rotating shaft 40 and a positioning block 91 disposed for working with the sensor 90 is solidly connected to the rotating shaft 40. The sensor 90 has a signal transmitter and a signal receiver. When the thermal sublimation printer is actuated, the sensor 90 starts to send a signal. If no signal is received when the printer actuated, the stepper motor 60 controls the rotating shaft 40 of the platen to rotate in clockwise direction, and the positioning block 91 solidly mounted on the rotating shaft 40 rotates with the rotation of the rotating shaft 40 of the platen until the sensor 90 receives the signal, and then rotates in anticlockwise direction by a certain angle to the initial position. On the contrary, if a signal is received when the printer is actuated, the rotating shaft 40 rotates in the anticlockwise direction to a position at which no signal will be received, and then rotates in the clockwise direction by the same angle to the initial position.

Compared with the prior art, in the thermal sublimation printer of the present invention, the platen is only required to move up and down in a small extent in the course of switching between the paper feeding/reversing and the printing step. It needs to be done 8 times switching to finish printing one image product, and thus the time for printing of the printer can be effectively reduced. Further, in the course of paper pickup, paper feeding/reversing, and printing, a self-locking function of the worm shaft and worm gear helps to suspend the supply of power to the stepper motor driving the rotating shaft of the platen, thereby reducing power consumption and the cost.

What is claimed is:

1. An imaging apparatus, comprising:

a fixed print head;

a platen, capable of contacting or separating from the print head and having a roll shaft; and a rotating shaft of the platen, mounted in parallel with the roll shaft, capable of rotating within a certain range of angle, and sleeved with a first shaft bush, an elastic component, and a second shaft bush sequentially from two ends towards a center thereof, wherein the second shaft bush is solidly connected to the rotating shaft, two ends of the elastic component are respectively connected to the first shaft bush and the second shaft bush, the first shaft bush has a first connection hole and a second connection hole, the one end of the rotating shaft is fitted in the first connection hole, and one end of the roll shaft of the platen is fitted in the second connection hole;

wherein when the platen separates from the print head, the first shaft bush sways up and down along with the rotation of the rotating shaft, so as to drive the platen to move up and down; and when the platen contacts the print head, the rotating shaft rotates relative to the first shaft bush, so as to deform the elastic component to generate a torsion.

2. The imaging apparatus as claimed in claim 1, wherein the second shaft bush and the rotating shaft are solidly connected through a D-shaped slot combination.

3. The imaging apparatus as claimed in claim 1, further comprising a stepper motor drive system for driving and precisely controlling the rotation of the rotating shaft of the platen within a certain range of angle.

4. The imaging apparatus as claimed in claim 3, further comprising a transmission system for driving the rotating shaft of the platen to rotate, wherein the transmission system comprises a worm shaft and a worm gear, and the worm shaft is engaged with the worm gear.

5. The imaging apparatus as claimed in claim 4, wherein the transmission system further comprises a first gear coaxial with the worm gear and a second gear engaged with the first gear, and power of the stepper motor drive system is transmitted to the rotating shaft of the platen through the second gear.

6. A thermal sublimation printer, comprising a paper pickup unit, a printing unit, and a paper cassette for accommodating papers, wherein the paper pickup unit comprises at leas one paper pickup roller and a paper lift plate, the paper lift plate has a first end adjacent to the at least one paper pickup roller and a second end adjacent to the printing unit, the second end has a fulcrum, and the paper lift plate is rotatable around the fulcrum within a certain range of angle;

the printing unit comprises a fixed print head, a platen capable of contacting or separating from the print head, and a rotating shaft of the platen mounted in parallel with the platen and capable of rotating within a certain range of angle, the platen has a roll shaft, the rotating shaft of the platen is sleeved with a first shaft bush, an elastic component, and a second shaft bush sequentially from two ends towards a center thereof, the second shaft bush is fixed on the rotating shaft, two ends of the elastic component are connected to the first shaft bush and the second shaft bush respectively, the first shaft bush has a first connection hole and a second connection hole, the one end of the rotating shaft is fitted in the first connection hole, and one end of the roll shaft of the platen is fitted in the second connection hole;

wherein when the platen contacts the print head, the rotating shaft rotates relative to the first shaft bush, so as to deform the elastic component to generate a torsion; when the platen separates from the print head, the first shaft bush sways up and down along with the rotation of the rotating shaft, so as to drive the platen to move up and down to a laid flat position or a press-down position; and the platen when moving to the press-down position presses the second end of the paper lift plate, such that the paper lift plate rotates around the fulcrum to make the first end to tilt upwardly, and thus the paper in the paper cassette is lifted up to contact the paper pickup roller.

7. The thermal sublimation printer as claimed in claim 6, wherein the second shaft bush and the rotating shaft are solidly connected through a D-shaped slot combination.

8. The thermal sublimation printer as claimed in claim 6, further comprising a stepper motor drive system for driving and controlling the rotating shaft of the platen to rotate within a certain range of angle.

9. The thermal sublimation printer as claimed in claim 8, further comprising a transmission system for driving the rotating shaft of the platen to rotate, wherein the transmission system comprises a worm shaft and a worm gear, and the worm shaft is engaged with the worm gear.

10. The thermal sublimation printer as claimed in claim 9, wherein the transmission system further comprises a first gear coaxial with the worm gear and a second gear engaged with the first gear, and power of the stepper motor drive system is transmitted to the rotating shaft of the platen through the second gear.

11. The thermal sublimation printer as claimed in claim 6, further comprising a transferring unit, wherein when the platen moves to the laid flat position, the transferring unit performs a paper feeding/reversing action, and when the platen moves to the press-down position, a portion of the second end of the paper lift plate adjacent to the platen is pressed.

12. The thermal sublimation printer as claimed in claim 6, wherein the first end of the paper lift plate comprises a bending portion, and a shaft bore formed on the bending portion, and the second end of the paper lift plate comprises a bending portion and a shaft bore formed on the bending portion; wherein the first end and the second end are connected by a shaft inserted in the shaft bores; wherein the shaft is sleeved with a torsion spring, and two ends of the torsion spring are connected to the first end and the second end of the paper lift plate respectively.

13. The thermal sublimation printer as claimed in claim 6, wherein the paper cassette comprises a base plate having a bottom on which an hollowed portion is formed near the paper lift plate, a paper tray disposed on the bottom and comprising a movable end and an opposite fixed end, and a cover; wherein the first end of the paper lift plate is fitted into the hollowed portion, and the movable end is positioned on the hollowed portion; wherein when the first end of the paper lift plate tilts upwardly, the movable end of the paper tray is lifted up accordingly.

14. A thermal sublimation printer, comprising a paper pickup unit, a printing unit, and a paper cassette for accommodating paper, wherein:

the paper pickup unit comprises at least one paper pickup roller and a paper lift plate, the paper lift plate has a first end adjacent to the at least one paper pickup roller and a second end adjacent to the printing unit, the second end has at least one pivot point, and the paper lift plate rotates around the pivot point as a fulcrum within a certain range of angle; and the printing unit comprises a fixed print head, a platen capable of contacting or separating from the print head, and a rotating shaft of the platen capable of rotating within a certain range of angle to drive the platen to contact or separate from the print head;

wherein when the platen separates from the print head, the platen is at a first position or a second position, the clearance between the platen at the first position and the print head is smaller than the clearance between the platen at the second position and the print head, and when the platen is at the second position, the platen presses the second end of the paper lift plate, such that the paper lift plate rotates around the fulcrum to make the first end to tilt upwardly, and thus the paper in the paper cassette is lifted up to contact the paper pickup roller.

15. The thermal sublimation printer as claimed in claim 14, further comprising a stepper motor drive system for driving and precisely controlling the rotating shaft of the platen to rotate within a certain range of angle.

16. The thermal sublimation printer as claimed in claim 15, further comprising a transmission system for driving the rotating shaft of the platen to rotate, wherein the transmission system comprises a worm shaft and a worm gear, and the worm shaft is engaged with the worm gear.

17. The thermal sublimation printer as claimed in claim 16, wherein the transmission system further comprises a first gear coaxial with the worm gear and a second gear engaged with the first gear, and power of the stepper motor drive system is transmitted to the rotating shaft of the platen through the second gear.

18. The thermal sublimation printer as claimed in claim 14, further comprising a transferring unit, wherein when the platen is at the first position, the transferring unit performs a paper feeding/reversing action, and when the platen moves to the second position, a portion of the second end of the paper lift plate adjacent to the platen is pressed.

19. The thermal sublimation printer as claimed in claim 14, wherein the first end and the second end of the paper lift plate are connected by a shaft, the shaft is sleeved with a torsion spring, and two ends of the torsion spring are respectively connected to the first end and the second end of the paper lift plate.

20. The thermal sublimation printer as claimed in claim 14, wherein the paper cassette comprises a base plate having a bottom on which an hollowed portion is formed near the paper lift plate, a paper tray disposed on the bottom and comprising a movable end and an opposite fixed end, and a cover; wherein the first end of the paper lift plate is fitted in the hollowed portion, and the movable end is positioned on the hollowed portion; wherein when the first end of the paper lift plate tilts upwardly, the movable end of the paper tray is lifted up accordingly.

* * * * *